US010907871B2

(12) United States Patent
Kinoshita et al.

(10) Patent No.: US 10,907,871 B2
(45) Date of Patent: Feb. 2, 2021

(54) REFRIGERANT FLOW PATH SWITCH AND AIR CONDITIONER

(71) Applicant: Hitachi-Johnson Controls Air Conditioning, Inc., Tokyo (JP)

(72) Inventors: Hiroki Kinoshita, Tokyo (JP); Kazuhiro Tsuchihashi, Tokyo (JP); Naoyuki Fushimi, Tokyo (JP); Toshiki Mochizuki, Tokyo (JP); Shuntaro Inoue, Tokyo (JP); Masayoshi Murofushi, Tokyo (JP); Yoshinori Iwashina, Tokyo (JP); Kazuhiko Tani, Tokyo (JP)

(73) Assignee: HITACHI-JOHNSON CONTROLS AIR CONDITIONING, INC., Tokyo (JP)

( * ) Notice: Subject to any disclaimer, the term of this patent is extended or adjusted under 35 U.S.C. 154(b) by 63 days.

(21) Appl. No.: 16/200,889

(22) Filed: Nov. 27, 2018

(65) Prior Publication Data

US 2019/0093931 A1 Mar. 28, 2019

Related U.S. Application Data

(63) Continuation of application No. PCT/JP2018/014740, filed on Apr. 6, 2018.

(30) Foreign Application Priority Data

Apr. 27, 2017 (JP) ..... 2017-087900
Apr. 27, 2017 (JP) ..... 2017-087903

(51) Int. Cl.
*F25B 47/00* (2006.01)
*F25B 41/04* (2006.01)
(Continued)

(52) U.S. Cl.
CPC ..... *F25B 47/00* (2013.01); *F25B 13/00* (2013.01); *F25B 41/003* (2013.01); *F25B 41/04* (2013.01);
(Continued)

(58) Field of Classification Search
CPC .... F25B 47/00; F25B 2313/023–02344; F25B 41/003; B65D 81/38;
(Continued)

(56) References Cited

U.S. PATENT DOCUMENTS 6,158,229 A * 12/2000 Aizawa ..... F25B 41/003 62/77
6,839,966 B2 * 1/2005 Kakinuma ..... F16L 41/03 29/890.14
(Continued)

FOREIGN PATENT DOCUMENTS

JP 2013-174424 A 9/2013
JP 5282666 B2 9/2013
(Continued)

OTHER PUBLICATIONS

Machine translation of Satoshi (JP 2013174424) (Year: 2013).*
(Continued)

*Primary Examiner* — Andrew D Stclair
(74) *Attorney, Agent, or Firm* — Mattingly & Malur, PC

(57) ABSTRACT

A refrigerant flow path switch arranged between an outdoor device and each of multiple indoor devices controls a refrigerant flow and is provided with a housing; a refrigerant flow path switching circuit having multiple refrigerant flow path switching circuits, wherein each refrigerant flow path switching circuit includes a high/low pressure gas pipe, a low pressure gas pipe, a high/low pressure electric valve provided at the high/low pressure gas pipe, and a low pressure electric valve provided at the low pressure gas pipe.
(Continued)

A liquid pipe assembly is arranged in the housing and has multiple liquid pipes connected to the multiple indoor devices. A first divider plate is provided between adjacent ones of the refrigerant flow path switching circuits and divides an internal space of the housing such that a space divided by the first divider plate is in a substantially cubic shape, which is filled with a foaming agent.

11 Claims, 3 Drawing Sheets

(51) Int. Cl.
*F25B 13/00* (2006.01)
*F25B 41/00* (2006.01)
*F25B 49/02* (2006.01)

(52) U.S. Cl.
CPC ..... *F25B 41/046* (2013.01); *F25B 49/02* (2013.01); *F25B 2313/027* (2013.01); *F25B 2313/0231* (2013.01); *F25B 2313/0233* (2013.01); *F25B 2600/2507* (2013.01)

(58) Field of Classification Search
CPC ..... F25D 2201/00–30; B29C 44/187; B29C 44/188; F24F 1/26; F24F 1/28; F24F 1/30; F24F 1/32; F24F 1/34
See application file for complete search history.

(56) References Cited

U.S. PATENT DOCUMENTS

| | | | | |
|---|---|---|---|---|
| 8,104,303 | B2 * | 1/2012 | Murata | F24F 1/26 62/290 |
| 2009/0049855 | A1 * | 2/2009 | Murata | F25D 23/00 62/259.1 |
| 2011/0219803 | A1 * | 9/2011 | Park | F24F 1/26 62/238.6 |
| 2012/0000230 | A1 * | 1/2012 | Matsuura | F24F 1/32 62/259.1 |
| 2012/0211209 | A1 * | 8/2012 | Choi | F16L 19/086 165/178 |
| 2013/0014525 | A1 * | 1/2013 | Koge | F25B 41/003 62/126 |

FOREIGN PATENT DOCUMENTS

| | | |
|---|---|---|
| JP | 2015-158319 A | 9/2015 |
| WO | 2017/042967 A1 | 3/2017 |

OTHER PUBLICATIONS

Machine translation of Kotani (JP 5282666) (Year: 2009).*
International Search Report of PCT/JP2018/014740 dated Jun. 9, 2018.

* cited by examiner

REFRIGERANT FLOW PATH SWITCH AND AIR CONDITIONER

CROSS-REFERENCE TO RELATED APPLICATION

This application is a continuation application of International Application No. PCT/JP2018/014740, filed on Apr. 6, 2018, which claims priority to Japanese Patent Application No. 2017-087900 filed on Apr. 27, 2017, and Japanese Patent Application No. 2017-087903 filed on Apr. 27, 2017.

BACKGROUND

1. Technical Field

The present disclosure relates to a refrigerant flow path switching device, and an air conditioner.

2. Description of the Related Art

A so-called multi air conditioner has been known, in which an indoor device is provided for each room and cooling and heating can be performed at the same time independently for the indoor devices. This air conditioner is used at a building, a commercial facility, and the like, for example. In the multi air conditioner, a refrigerant flow direction is controlled for each indoor device, and cooling and heating in each indoor device are changeable.

In the multi air conditioner, a refrigerant flow path switch configured to switch the direction of a refrigerant flow to each indoor device is provided between an outdoor device and each of the multiple indoor devices. Two types of refrigerant flow path switches including an assembly type that multiple indoor devices are connected to a single refrigerant flow path switch and an independent type that a single refrigerant flow path switch is provided for each indoor device have been known as the refrigerant flow path switch.

Of these devices, the former assembly-type refrigerant flow path switch is specifically connected to a high/low pressure gas pipe and a low pressure gas pipe connected to the outdoor device, a gas pipe connected to each indoor device, and a liquid pipe connected to each indoor device as an assembly different from the gas pipe. Moreover, electric valves are provided in the middle of the high/low pressure gas pipe and the low pressure gas pipe. Opening/closing of these valves is controlled, so that the refrigerant flow direction in each indoor device can be controlled.

The refrigerant flow path switch is mainly placed in a ceiling, and the inside of the device needs to be thermally insulated to prevent leakage of condensation water from the device through the ceiling. Thus, a structure is preferable, in which the inside of the device is filled with a heat insulating material such as a foaming agent to enhance heat insulating properties and prevent dew condensation.

However, in the assembly-type refrigerant flow path switch, when a common space in a housing is provided, the internal space is large. Thus, even when an attempt is made to form the heat insulating material by injection of a liquid foaming agent into the housing, the foaming agent is solidified before spreading across the entirety of the inside of the housing, and cavities might be formed in the housing. With the cavities in the housing, dew condensation might occur on pipe surfaces at these portions, and water droplets might drop from the housing.

For solving such a problem, in, e.g., a refrigerant flow path switch of Japanese Patent No. 5282666, divider plates are arranged in a space in a casing in which multiple refrigerant pipe assemblies are arranged, and divide the space in the casing for each refrigerant pipe assembly. Moreover, each refrigerant pipe assembly is filled with a foaming agent for reduction of dew condensation.

SUMMARY

A refrigerant flow path switch according to an embodiment of the present disclosure is arranged between an outdoor device and each of multiple indoor devices to control a refrigerant flow, the refrigerant flow path switch includes a housing; a refrigerant flow path switching circuit assembly arranged in the housing and having multiple refrigerant flow path switching circuits, each refrigerant flow path switching circuit including a high/low pressure gas pipe, a low pressure gas pipe, a high/low pressure electric valve provided at the high/low pressure gas pipe, and a low pressure electric valve provided at the low pressure gas pipe; a liquid pipe assembly arranged in the housing and having multiple liquid pipes connected to the multiple indoor devices; and a first divider plate provided between adjacent ones of the refrigerant flow path switching circuits in the housing and configured to divide an internal space of the housing, wherein a space divided by the first divider plate is in a substantially cubic shape, and the divided space is filled with a foaming agent.

DESCRIPTION OF THE EMBODIMENTS

Figure 1:
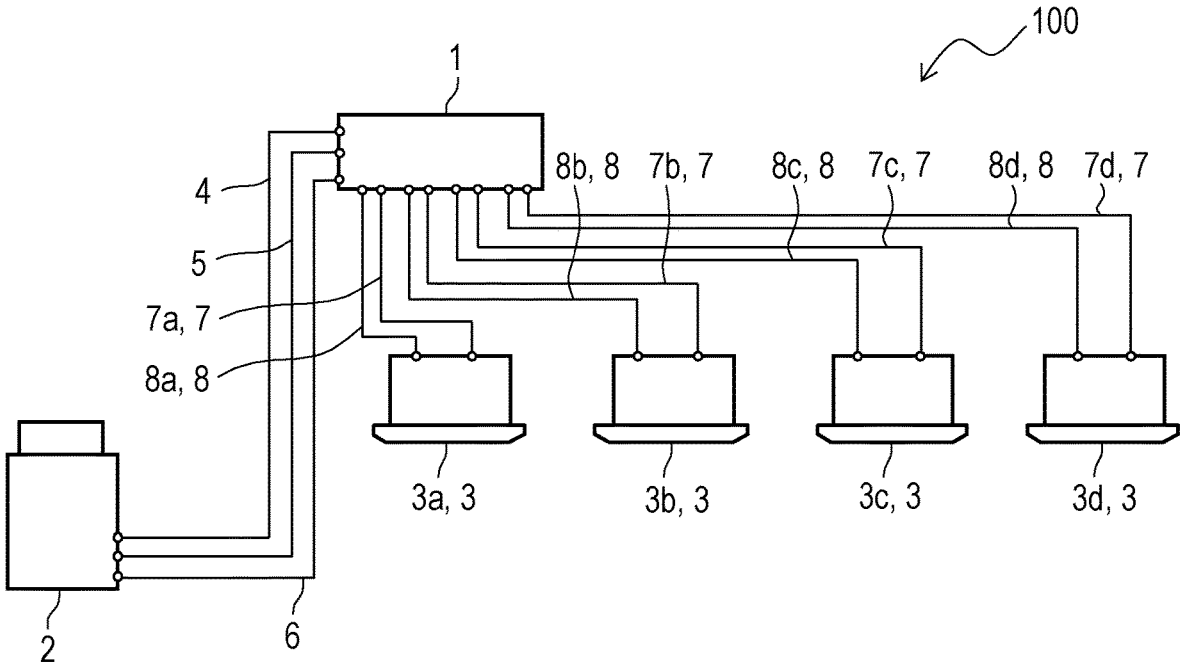
FIG. 1 illustrates an entire configuration diagram of an air conditioning system including a refrigerant flow path switch.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

However, in the refrigerant flow path switch described in Japanese Patent No. 5282666, the divider plates divide the space for each refrigerant pipe assembly to form spaces. This leads to an increase in the number of divider plates and greater housing dimensions in addition to a weight increase, an increase in the number of times of foam charging, and a cost increase. Moreover, in the refrigerant flow path switch described in Japanese Patent No. 5282666, foam charging is performed for each refrigerant pipe assembly to fill an entire area in the casing. This leads to a greater amount of charged foaming agent.

Thus, the present disclosure is intended to provide a refrigerant flow path switch configured so that the inside of a housing can be filled with a foaming agent without clearances and the number of times of foam charging and a charging amount can be reduced and an air conditioner. Moreover, the present disclosure is further intended to provide a refrigerant flow path switch configured so that a foaming agent charging amount can be reduced while occurrence of dew condensation is reduced and an air conditioner.

Solution to the Problems

For accomplishing the above-described objectives, a refrigerant flow path switch according to one embodiment of the present disclosure is a refrigerant flow path switch arranged between an outdoor device and each of multiple indoor devices to control a refrigerant flow. The refrigerant flow path switch includes a housing; a refrigerant flow path switching circuit assembly arranged in the housing and having multiple refrigerant flow path switching circuits, each refrigerant flow path switching circuit including a high/low pressure gas pipe, a low pressure gas pipe, a high/low pressure electric valve provided at the high/low pressure gas pipe, and a low pressure electric valve provided at the low pressure gas pipe; a liquid pipe assembly arranged in the housing and having multiple liquid pipes connected to the multiple indoor devices; and a first divider plate provided between adjacent ones of the refrigerant flow path switching circuits in the housing and configured to divide an internal space of the housing. A space divided by the first divider plate is in a substantially cubic shape, and the divided space is filled with a foaming agent.

Moreover, a refrigerant flow path switch according to one embodiment of the present disclosure is a refrigerant flow path switch arranged between an outdoor device and each of multiple indoor devices to control a refrigerant flow. The refrigerant flow path switch includes a housing including a first region and a second region; a refrigerant flow path switching circuit assembly arranged in the first region and having multiple refrigerant flow path switching circuits, each refrigerant flow path switching circuit including a high/low pressure gas pipe, a low pressure gas pipe, a high/low pressure electric valve provided at the high/low pressure gas pipe, and a low pressure electric valve provided at the low pressure gas pipe; a liquid pipe assembly arranged in the second region and having multiple liquid pipes connected to the multiple indoor devices; a divider plate configured to separate the first region and the second region; and a heat insulating member provided in the first region.

According to the present embodiment, a refrigerant flow path switch configured so that the inside of a housing can be filled with a foaming agent without clearances and the number of times of foam charging and a charging amount can be reduced and an air conditioner can be provided. Moreover, according to the present embodiment, a refrigerant flow path switch configured so that a foaming agent charging amount can be reduced while occurrence of dew condensation is reduced and an air conditioner can be provided.

Hereinafter, an embodiment (the present embodiment) of the present disclosure will be described with reference to the drawings. Note that each figure is schematic, and for the sake of easy grasping of the present embodiment, some of members might be omitted or simplified as necessary without departing from the gist of the present embodiment or might be visualized for illustrating an internal structure.

FIG. 1 illustrates a system diagram of an air conditioner 100 including a refrigerant flow path switch 1 of the present embodiment.

The air conditioner 100 is a simultaneous cooling-heating type multi air conditioner configured so that cooling and heating can be simultaneously performed for each indoor device 3.

The air conditioner 100 includes the refrigerant flow path switch 1, an outdoor device 2, the multiple indoor devices 3 (3*a*, 3*b*, 3*c*, 3*d*), a first high/low pressure gas pipe 4, a first low pressure gas pipe 5, a first liquid pipe 6, first gas pipes 7 (7*a*, 7*b*, 7*c*, 7*d*), and second liquid pipes 8 (8*a*, 8*b*, 8*c*, 8*d*). The first high/low pressure gas pipe 4, the first low pressure gas pipe 5, and the first liquid pipe 6 connect the refrigerant flow path switch 1 and the outdoor device 2. The first gas pipes 7 connect the refrigerant flow path switch 1 and the multiple indoor devices 3. The second liquid pipes 8 connect the outdoor device 2 and the multiple indoor devices 3.

The first high/low pressure gas pipe 4 is also called a discharge gas pipe, and the first low pressure gas pipe 5 is also called a suction gas pipe. Moreover, the refrigerant flow path switch 1 and the outdoor device 2 are connected to each other via three pipes of the first high/low pressure gas pipe 4, the first low pressure gas pipe 5, and the first liquid pipe 6, and therefore, the air conditioner 100 is a so-called three-pipe air conditioner.

Although not shown in the figure, the outdoor device 2 includes a compressor configured to compress refrigerant to be supplied to the refrigerant flow path switch 1, two outdoor heat exchangers (a condenser and an evaporator) configured to exchange heat between outdoor air and refrigerant, an outdoor expansion valve configured to expand refrigerant before or after (varies according to cooling-centered or heating-centered operation) heat exchange in the outdoor heat exchanger, and a four-way valve configured to switch a refrigerant flow path according to the cooling-centered or heating-centered operation. Note that the first high/low pressure gas pipe 4 is configured switchable to a high pressure gas pipe or a low pressure gas pipe in the outdoor device 2 according to a four-way valve switching direction. The first low pressure gas pipe 5 is connected to a suction side of the compressor. The first liquid pipe 6 is connected to an expansion valve side of the outdoor heat exchanger (the condenser) of the outdoor device 2.

Further, although not shown in the figure, the indoor device 3 includes an indoor heat exchanger configured to exchange heat between indoor air and refrigerant, and an indoor expansion valve configured to expand refrigerant before or after (varies according to an operation mode of the indoor device) heat exchange in the indoor heat exchanger.

These components are connected to each other via the pipes, and refrigerant flows in the pipes. In this manner, a refrigeration cycle is formed between the outdoor device 2 and each indoor device 3. Specifically, in the refrigerant flow path switch 1 arranged between the outdoor device 2 and each indoor device 3, a flow direction of refrigerant to be supplied from the outdoor device 2 to the indoor device 3 is controlled, so that cooling and heating can be performed at the same time independently for the indoor devices 3.

Next, the refrigerant flow path switch 1 will be described.

Figure 2:
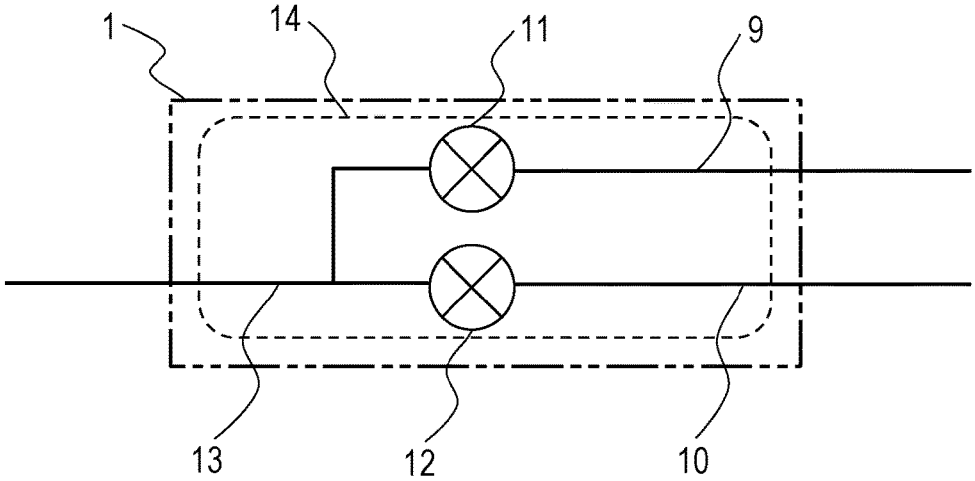
FIG. 2 illustrates a refrigerant circuit diagram of an independent-type refrigerant flow path switch.

FIG. 2 illustrates a refrigerant circuit diagram of the independent-type refrigerant flow path switch 1.

As illustrated in FIG. 2, the independent-type refrigerant flow path switch 1 includes a second high/low pressure gas pipe 9, a second low pressure gas pipe 10, a high/low pressure electric valve 11, a low pressure electric valve 12, and a second gas pipe 13. The second high/low pressure gas pipe 9 is connected to the first high/low pressure gas pipe 4, the second low pressure gas pipe 10 is connected to the first low pressure gas pipe 5, and the second gas pipe 13 is connected to the first gas pipes 7. In the refrigerant flow path switch 1 connected to the indoor devices 3 performing cooling operation, the high/low pressure electric valve 11 and the low pressure electric valve 12 are opened, and a flow in the second high/low pressure gas pipe 9 and the second low pressure gas pipe 10 is allowed. Note that a case where a flow in the second high/low pressure gas pipe 9 is allowed is a case where all of the indoor devices 3 perform the cooling operation. In simultaneous cooling-heating operation, it is controlled such that the high/low pressure electric valve 11 is closed to inhibit a flow in the second high/low pressure gas pipe 9 and the second gas pipe 13.

In the refrigerant flow path switch 1 connected to the indoor devices 3 performing heating operation, it is controlled such that the high/low pressure electric valve 11 is opened to allow a flow in the second high/low pressure gas pipe 9 and the second gas pipe 13 and the low pressure electric valve 12 is closed to inhibit a flow in the second low pressure gas pipe 10 and the second gas pipe 13. Then, a flow from the second gas pipe 13 to the indoor devices 3 via the first gas pipes 7 is allowed. This refrigerant circuit of the refrigerant flow path switch 1 is taken as a refrigerant flow path switching circuit 14.

The refrigerant circuit diagram of the refrigerant flow path switching circuit 14 illustrated in FIG. 2 shows such an independent type that a single refrigerant flow path switch 1 is provided for each indoor device 3. On the other hand, an assembly type has been known, in which multiple indoor devices 3 are connected to a single refrigerant flow path switch 1.

Next, the assembly-type refrigerant flow path switch 1 will be described based on FIGS. 3 to 6.

Figure 3:
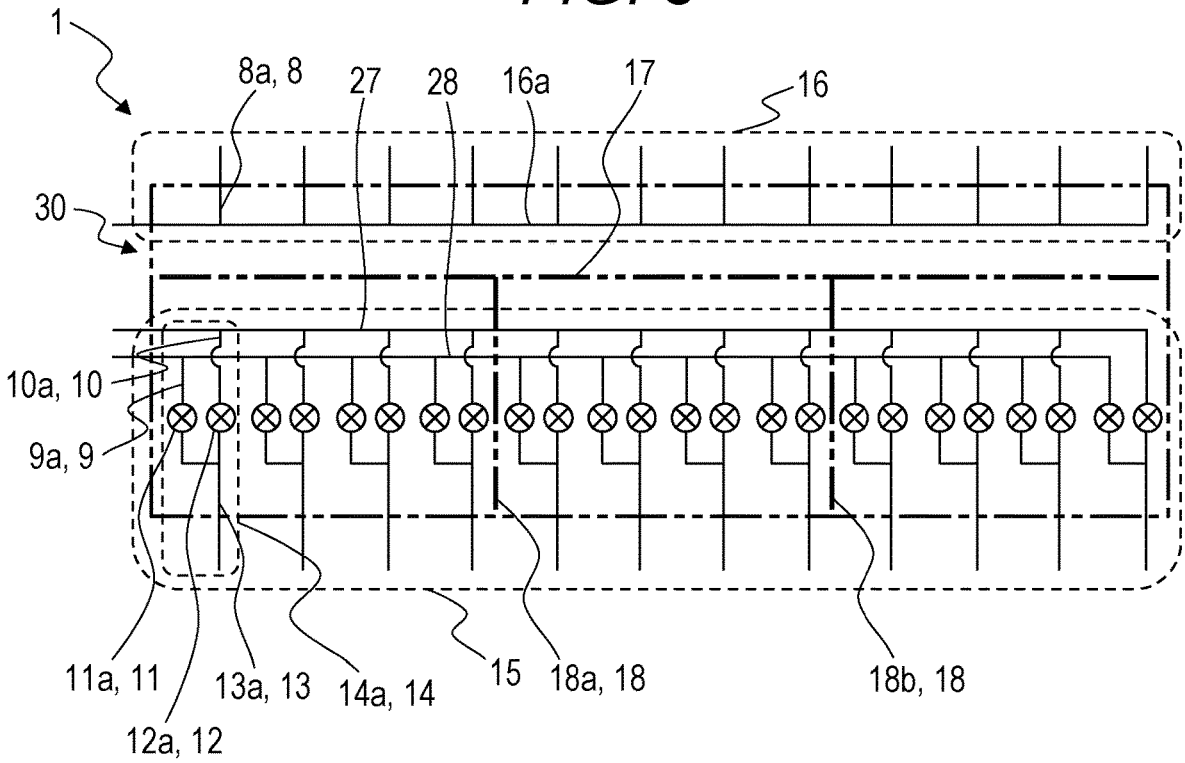
FIG. 3 illustrates a refrigerant circuit diagram of an assembly-type refrigerant flow path switch.
Figure 4:
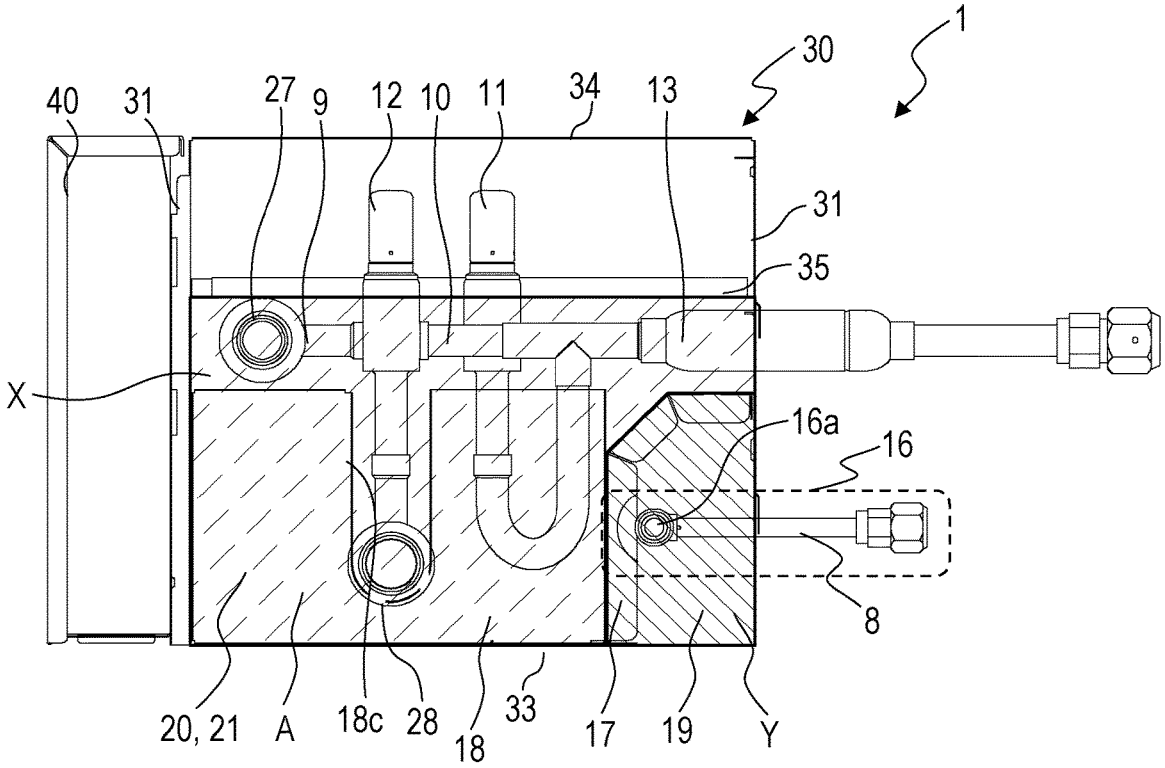
FIG. 4 is a schematic view of the refrigerant flow path switch from a lateral side, and illustrates a foam charging area.
Figure 5:
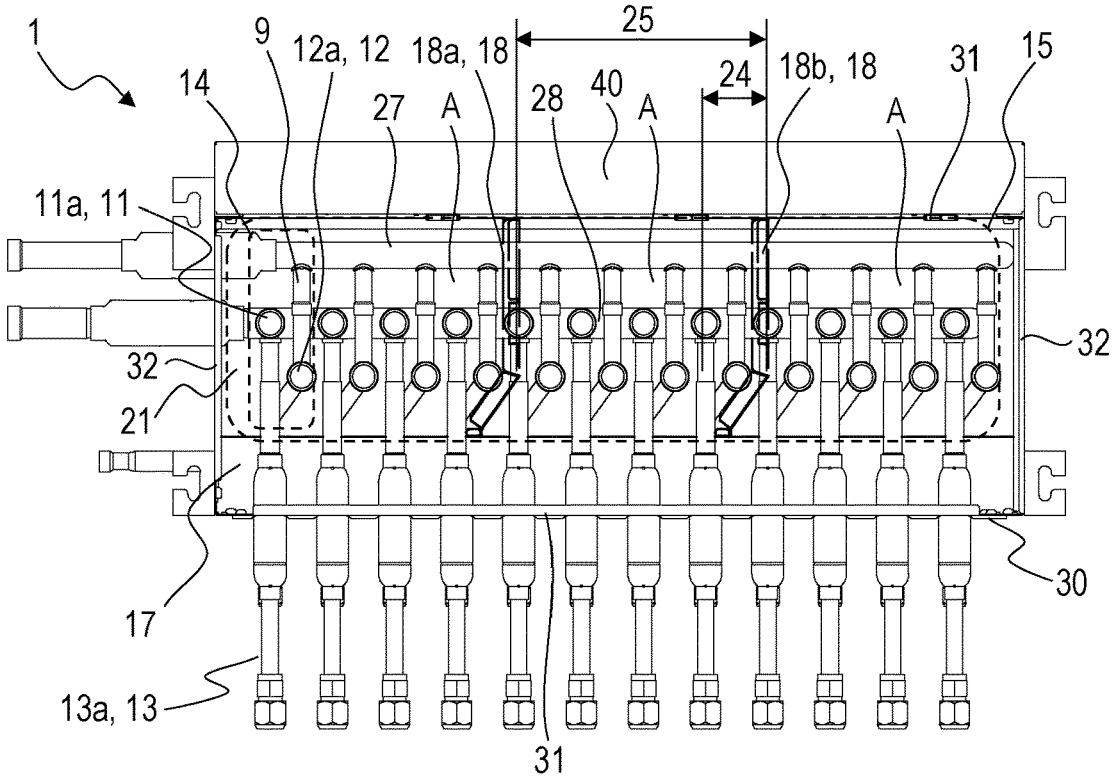
FIG. 5 is a schematic view of the refrigerant flow path switch from above, and illustrates the inside of a housing.
Figure 6:
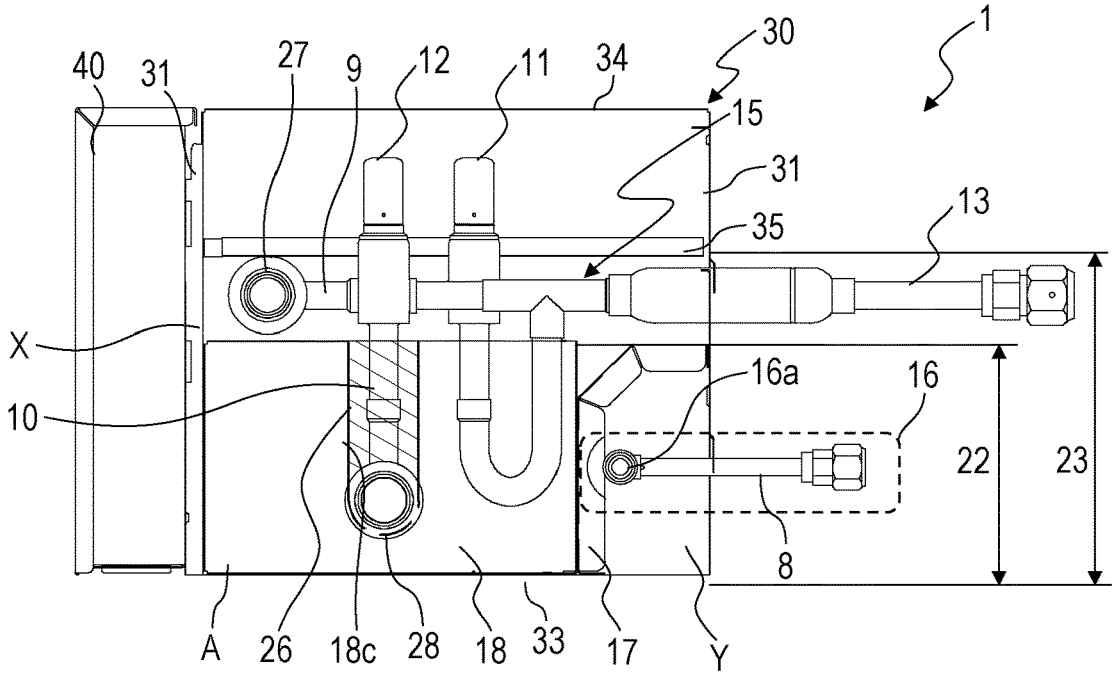
FIG. 6 is a schematic view of the refrigerant flow path switch from a lateral side, and illustrates the inside of the housing.

FIG. 3 illustrates a refrigerant circuit diagram of the assembly-type refrigerant flow path switch 1. FIG. 4 is a schematic view of the refrigerant flow path switch 1 from a lateral side, and illustrates a foam charging area. FIG. 5 is a schematic view of the refrigerant flow path switch 1 from above, and illustrates the inside of a housing 30. FIG. 6 is a schematic view of the refrigerant flow path switch 1 from a lateral side, and illustrates the inside of the housing 30.

As illustrated in FIGS. 3 to 6, the assembly-type refrigerant flow path switch 1 includes the housing 30 having a rectangular parallelepiped outer shape, an electric box 40 where a control board is built in, a refrigerant flow path switching circuit assembly 15, a liquid pipe assembly 16.

As illustrated in FIGS. 4 and 5, the housing 30 includes a pair of first side plates 31 parallel to a longitudinal direction, a pair of second side plates 32 parallel to a lateral direction, a bottom plate 33, an upper plate 34, and an inner plate 35. In the housing 30, multiple first divider plates 18 (18*a*, 18*b*) and a second divider plate 17 are provided. The second divider plate 17 has, as viewed laterally, a portion extending perpendicularly from the bottom plate 33, a portion extending perpendicularly from the first side plate 31 on the opposite side of the electric box 40, and a portion connecting both of these portions. The second divider plate 17 extends along the longitudinal direction of the housing 30. By the second divider plate 17, an internal space of the housing 30 is divided into a first region X and a second region Y. The second region Y is defined by the second divider plate 17, the bottom plate 33, the first side plate 31, and the pair of second side plates 32. Thus, the second region Y is formed with a simple configuration. Moreover, the electric box 40 is connected to one first side plate 31.

The refrigerant flow path switching circuit assembly 15 is arranged in the first region X, and the liquid pipe assembly 16 is arranged in the second region Y.

The refrigerant flow path switching circuit assembly 15 includes a high/low pressure common gas pipe 27, a low pressure common gas pipe 28, and multiple refrigerant flow path switching circuits 14 (14*a*). As described above, the refrigerant flow path switching circuit 14 includes the second high/low pressure gas pipe 9, the second low pressure gas pipe 10, the high/low pressure electric valve 11 (11*a*), the low pressure electric valve 12 (12*a*), and the second gas pipe 13. The high/low pressure common gas pipe 27 extends along the longitudinal direction of the housing 30, and is connected to the second high/low pressure gas pipe 9 of each refrigerant flow path switching circuit 14. The low pressure common gas pipe 28 extends along the longitudinal direction of the housing 30, and is connected to the second low pressure gas pipe 10 of each refrigerant flow path switching circuit 14. The second gas pipe 13 of each refrigerant flow path switching circuit 14 extends along the lateral direction of the housing 30, and is connected to the first gas pipes 7. In FIG. 3, the refrigerant flow path switching circuit assembly 15 is configured such that 12 refrigerant flow path switching circuits 14 are coupled to each other along the longitudinal direction. The second gas pipe 13 passes above the second divider plate 17, and penetrates the first side plate 31.

As illustrated in FIGS. 3 and 5, each first divider plate 18 (18*a*, 18*b*) is provided between adjacent ones of the refrigerant flow path switching circuits 14, and is provided for every multiple (in the present embodiment, four) refrigerant flow path switching circuits 14. By the first divider plates 18, the internal space of the housing 30 is divided into substantially cubic spaces. Moreover, each first divider plate 18 extends from the second divider plate 17 to the first side plate 31 on an electric box 40 side. In the present embodiment, the internal space of the housing 30 is divided by the first divider plates 18, the second divider plate 17, and the upper plate 35, and substantially cubic spaces A are formed. Moreover, the upper plate 35 is provided to cover the refrigerant flow path switching circuit assembly 15 from above.

In the space A, at least part of the second high/low pressure gas pipe 9, at least part of the second low pressure gas pipe 10, the high/low pressure electric valve 11, the low pressure electric valve 12, and at least part of the second gas pipe 13 are positioned at an upper portion of the space A, and the heights of the first divider plates 18 and the second divider plate 17 are set lower than that of the upper portion of the space A. Moreover, as illustrated in FIG. 6, cutouts 18*c* opening on an upper side are formed at the first divider plates 18, and the low pressure common gas pipe 28 penetrates lower portions of the cutouts 18*c*. Heat insulating materials 26 (shaded portions) are bonded to fill the cutouts 18*c*.

As illustrated in FIG. 4, an area indicated by a dot-line portion 20 in the space A is filled with a foaming agent (a heat insulating member) 21. For example, the inside of the space A is filled with the foaming agent (the heat insulating member) 21 in such a manner that the foaming agent in the form of liquid is dripped through a hole formed at the inner plate 35 and is expanded thereafter. For example, a liquid mixture of INS-A and RIGID-200 is used as the foaming agent.

The liquid pipe assembly 16 includes a common liquid pipe 16*a* and the multiple second liquid pipes 8 (8*a*), and is positioned below the second gas pipe 13. The common liquid pipe 16*a* extends along the longitudinal direction of the housing 30. Each second liquid pipe 8 is connected to the common liquid pipe 16*a*, and extends along the lateral direction of the housing 30. The multiple second liquid pipes 8 of the liquid pipe assembly 16 are not connected to the refrigerant flow path switching circuits 14 of the refrigerant flow path switching circuit assembly 15. That is, the refrigerant flow path switching circuit assembly 15 and the liquid pipe assembly 16 are configured independently of each other.

As illustrated in FIGS. 3 and 4, the liquid pipe assembly 16 does not relate to switching of a refrigerant flow, and therefore, the liquid pipe assembly 16 is not necessarily provided in the refrigerant flow path switch 1. However, the assembly type includes the multiple indoor devices 3, and for this reason, in site work, it is necessary to check which indoor device 3 is to be connected to which pipe. This leads to poor workability. For these reasons, the liquid pipe assembly 16 is arranged in the refrigerant flow path switch 1 so that a work location to be focused can be determined and the first gas pipes 7 can be processed simultaneously. Thus, workability can be enhanced without time and effort for a checking process. This is because the liquid pipe assembly 16 is arranged in the refrigerant flow path switch 1.

The second liquid pipes 8 have a high pipe temperature, and therefore, there are less concerns on dew condensation. For reduction of a foam charging amount and shortening of a foam charging time, foam charging is not performed. Note that although the foaming agent is not charged, the periphery of the second liquid pipes 8 may be covered with a heat insulating member (e.g., EPT and polyethylene). Thus, in FIG. 4, foam charging is not performed for a shaded portion 19 corresponding to the second region Y. As described above, foam charging is not necessarily performed for the liquid pipe assembly 16, and therefore, the refrigerant flow path switching circuit assembly 15 for which foam charging is necessary and the liquid pipe assembly 16 are separated by the second divider plate 17. That is, the refrigerant flow path switching circuit assembly 15 and the liquid pipe assembly 16 are independent from each other. Thus, the first region X and the second region Y are only simply divided by the second divider plate 17, and therefore, a simple structure can be provided.

Each first divider plate 18 (18*a*, 18*b*) is provided between adjacent ones of the refrigerant flow path switching circuits 14, thereby forming the spaces A. In a case where no first divider plates 18 are provided, the space in the housing 30 is large. For this reason, the foaming agent is solidified before spreading across the entire space, leading to cavities in the housing 30. This leads to foaming failure. When the first divider plate 18 is, for all of the refrigerant flow path switching circuits 14, provided in each portion between adjacent ones of the refrigerant flow path switching circuits 14, the space is small, and an area targeted for foam charging is also small. For this reason, the foaming agent can be charged into every corner of the space. However, the number of first divider plates 18 is great. This leads to a greater number of first divider plates 18, a greater weight, and a higher cost. Further, foam charging needs to be performed for each refrigerant flow path switching circuit 14. This leads to a longer foam charging time and lower workability.

On the other hand, in the present embodiment, the refrigerant flow path switching circuit assembly 15 is divided for every multiple (four) refrigerant flow path switching circuits 14 by the first divider plates 18. In this manner, the spaces A formed by such division are in the substantially cubic shape, and are filled with the foaming agent. Since the substantially cubic spaces A are formed as described above, the foaming agent uniformly expands each side, so that the inside of the spaces A can be filled without clearances. Thus, the number of first divider plates 18 can be reduced, and the number of times of foam charging and the charging amount can be reduced while charging failure is reduced. The upper view of the refrigerant flow path switch 1 of FIG. 5 shows that the refrigerant flow path switching circuit assembly 15 is divided for every four refrigerant flow path switching circuits 14 by the first divider plates 18. Since the number of times of foam charging and the charging amount can be reduced, the cost of the refrigerant flow path switch 1 can be reduced, and therefore, the cost of the air conditioner 100 can be reduced.

Moreover, as illustrated in FIG. 6, it is configured such that the height 22 of the first divider plate 18 is lower than the height 23 of the foam charging area (the space A). For charging the foaming agent into every corner, the first divider plates 18 may be placed in an upper-to-lower direction to form completely-separated spaces. In the present embodiment, the space A in which the refrigerant flow path switching circuit assembly 15 is arranged is not divided for each refrigerant flow path switching circuit 14, but is divided for every multiple refrigerant flow path switching circuits 14 to form the substantially rectangular parallelepiped spaces A. Thus, as illustrated in FIG. 5, a width 25 in the case of division for every multiple refrigerant flow path switching circuits 14 is greater than a width 24 in the case of division for each refrigerant flow path switching circuit 14, and therefore, the amount of foaming agent leaking to adjacent refrigerant flow path switching circuits 14 upon foam charging can be reduced.

Thus, a proper amount of liquid foaming agent is dripped in the space A, so that the amount of foaming agent leaking to adjacent spaces A can be, without the need for completely separating the spaces A, reduced while the foaming agent can be charged into every corner of the space A. With this configuration, it is not necessary to completely separate the spaces A adjacent to each other by the first divider plates 18, and therefore, an increase in the number of divider plates and a cost increase can be suppressed without the need for increasing divider plates from an upper direction. Note that the heat insulating materials 26 are bonded to the cutouts 18*c* of the first divider plates 18, and therefore, leakage of the foaming agent to adjacent spaces A is reduced.

The inside of the housing 30 is divided into the first region X and the second region Y by the second divider plate 17, and only the first region X is filled with the foaming agent 21 as the heat insulating member. Thus, the amount of foaming agent to be charged can be reduced. Consequently, the low-cost refrigerant flow path switch 1 can be provided, and therefore, the cost of the air conditioner 100 can be reduced.

Note that the present embodiment is not limited to the above-described embodiment. Those skilled in the art can make various additions, changes, and the like within the scope of the present embodiment.

In the above-described embodiment, the refrigerant flow path switching circuit assembly 15 is divided for every four refrigerant flow path switching circuits 14 by the first divider plates 18 to form the substantially cubic spaces A. However, the number of refrigerant flow path switching circuits 14 is not limited to four, but may be any number as long as the substantially cubic spaces can be formed.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. A refrigerant flow path switch, disposed between an outdoor device and each of a plurality of indoor devices, configured to control a refrigerant flow, comprising:

a housing, comprising:

a bottom plate;

two first side plates parallel to one another;

two second side plates parallel to one another;

an upper plate; and an internal upper plate parallel to the upper plate;

a refrigerant flow path switching circuit assembly disposed in the housing and having a plurality of refrigerant flow path switching circuits, each refrigerant flow path switching circuit including a high/low pressure gas pipe, a low pressure gas pipe, a high/low pressure electric valve provided at the high/low pressure gas pipe, and a low pressure electric valve provided at the low pressure gas pipe;

a liquid pipe assembly disposed in the housing and having a plurality of liquid pipes connected to the multiple indoor devices; and a first divider plate disposed between adjacent refrigerant flow path switching circuits in the housing and configured to divide an internal space of the housing, wherein the internal space of the housing is divided by the first divider plate and a divided space is filled with a foaming agent, and wherein the internal upper plate is perpendicular to the first divider plate and disposed at a height higher than an uppermost top edge of the first divider plate, and in each refrigerant flow path switching circuit, part of the high/low pressure gas pipe, part of the low pressure gas pipe, the high/low pressure electric valve, and the low pressure electric valve are disposed above the internal upper plate.

2. The refrigerant flow path switch according to claim 1, further comprising:

a plurality of first divider plates including the first divider plate, wherein multiple refrigerant flow path switching circuits are disposed between adjacent first divider plates.

3. The refrigerant flow path switch according to claim 2, wherein four refrigerant flow path switching circuits are disposed between adjacent first divider plates.

4. The refrigerant flow path switch according to claim 1, further comprising:

a second divider plate provided in the housing and configured to separate the refrigerant flow path switching circuit assembly and the liquid pipe assembly, wherein the internal space of the housing is divided by the first divider plate and the second divider plate, and the divided space is filled with the foaming agent.

5. An air conditioner comprising:

an outdoor device;

multiple indoor devices; and the refrigerant flow path switch according to claim 1, wherein the refrigerant flow path switch is disposed between the outdoor device and each of the multiple indoor devices to control a refrigerant flow.

6. A refrigerant flow path switch, disposed between an outdoor device and each of a plurality of indoor devices, configured to control a refrigerant flow, comprising:

a housing, comprising:

a bottom plate;

two first side plates parallel to one another;

two second side plates parallel to one another;

an upper plate; and an internal upper plate parallel to the upper plate;

a refrigerant flow path switching circuit assembly disposed in the housing and having multiple refrigerant flow path switching circuits, each refrigerant flow path switching circuit including a high/low pressure gas pipe, a low pressure gas pipe, a high/low pressure electric valve provided at the high/low pressure gas pipe, and a low pressure electric valve provided at the low pressure gas pipe;

a liquid pipe assembly disposed in the housing and having a plurality of liquid pipes connected to the multiple indoor devices; and a first divider plate disposed between adjacent refrigerant flow path switching circuits in the housing and configured to divide an internal space of the housing, wherein the internal upper plate is perpendicular to the first divider plate and disposed at a height higher than an uppermost top edge of the first divider plate, wherein the housing further comprises a second divider plate separating the housing into a first region and a second region, wherein the first region of the internal space of the housing is divided by the first divider plate, includes the refrigerant flow path switching circuit assembly, and a divided space of the first region divided by the first divider plate is filled with a heat insulating member, and wherein the liquid pipe assembly is disposed in the second region, and in each refrigerant flow path switching circuit, part of the high/low pressure gas pipe, part of the low pressure gas pipe, the high/low pressure electric valve, and the low pressure electric valve are disposed above the internal upper plate.

7. The refrigerant flow path switch according to claim 6, wherein the refrigerant flow path switching circuit assembly and the liquid pipe assembly are separated from each other in the housing.

8. The refrigerant flow path switch according to claim 6, wherein the second region is bound by at least the second divider plate, the bottom plate, and one of the two first side plates.

9. An air conditioner comprising:

an outdoor device;

multiple indoor devices; and the refrigerant flow path switch according to claim 6, wherein the refrigerant flow path switch is disposed between the outdoor device and each of the multiple indoor devices to control a refrigerant flow.

10. The refrigerant flow path switch according to claim 1, wherein a first side of the first divider plate abuts one of the two first side plates and extends away from the one of the two first side plates, wherein the internal upper plate abuts the one of the two first side plates, and wherein the internal upper plate extends away from the one of the two first side plates further than the first divider plate.

11. The refrigerant flow path switch according to claim 6, wherein a first side of the first divider plate abuts one of the two first side plates and extends away from the one of the two first side plates, wherein the internal upper plate abuts the one of the two first side plates, and wherein the internal upper plate extends away from the one of the two first side plates further than the first divider plate.

* * * * *